US005867141A

United States Patent [19]

Asada et al.

[11] Patent Number: 5,867,141

[45] Date of Patent: Feb. 2, 1999

[54] DRIVING METHOD FOR LIQUID CRYSTAL DISPLAY OF GATE STORAGE STRUCTURE

[75] Inventors: Hideki Asada; Fujio Okumura, both of Tokyo, Japan

[73] Assignee: NEC Corporation, Tokyo, Japan

[21] Appl. No.: 624,741

[22] Filed: Mar. 27, 1996

[30] Foreign Application Priority Data

Mar. 30, 1995 [JP] Japan ..... 7-072584

[51] Int. Cl.[6] ..... G09G 3/36

[52] U.S. Cl. ..... 345/100; 345/94; 345/96

[58] Field of Search ..... 345/90, 92, 94, 345/95, 96, 97, 98, 99, 100, 52, 204, 209, 210, 213; 348/790–793

[56] References Cited

U.S. PATENT DOCUMENTS 4,412,214 10/1983 Tanaka et al. ..... 345/52
4,965,563 10/1990 Mano et al. ..... 345/99
5,357,290 10/1994 Horibe ..... 348/793
5,448,260 9/1995 Zenda et al. ..... 345/204
5,627,559 5/1997 Tsuboyama et al. ..... 345/97

FOREIGN PATENT DOCUMENTS 5341732 12/1993 Japan .

*Primary Examiner*—Steven J. Saras
*Assistant Examiner*—Xu-Ming Wu
*Attorney, Agent, or Firm*—Whitham, Curtis & Whitham

[57] ABSTRACT

A pair of neighboring scan lines are selected either for a black write action of an arbitrary signal line in a blanking period and the other for another black write action of the signal line in the blanking period, permitting a relatively small voltage shift to be caused in associated pixel voltages.

13 Claims, 7 Drawing Sheets

DRIVING METHOD FOR LIQUID CRYSTAL DISPLAY OF GATE STORAGE STRUCTURE

BACKGROUND OF THE INVENTION

The present invention generally relates to a driving method for a liquid crystal display (hereafter sometimes "LCD"), and particularly, to a driving method for an active matrix type LCD to be adaptive such as for a large-sized or presentation-oriented display or projector (hereafter collectively "PROJECTOR") or a high-grade television or high-definition television (hereafter collectively. "TV").

DESCRIPTION OF THE RELATED ART

Toward a full-dressed advent of a multi-media age, recent years have observed an increasing need for an LCD adaptive to various media, such as a personal computer, a work station and a variety of computing machines (hereafter collectively "COMPUTER"), a PROJECTOR and a TV, that may have their principal display specifications different from each other, such as in signal bandwidth, pixel number and scan modes.

Such an LCD needs to be cooperative with various signal sources.

For example, to be adaptive to a typical COMPUTER, the LCD needs to display a temporal sequence of single-field picture frames in response to a signal formatted for a non-interlacing scan mode.

On the other hand, to be adaptive to a PROJECTOR or TV, the LCD needs to display a temporal sequence of double-field picture frames in response to a signal formatted for an interlacing scan mode so that in each odd-numbered field, odd number lines are sequentially scanned, and in each even-numbered field, even number lines are sequentially scanned.

A typical LCD comprises a liquid crystal display member or panel composed of a back-lighted transparent pixel layer consisting of matrix-arrayed active pixels (hereafter sometimes each "Px(i, j)", as it is located at a j-th column of an i-th row) cooperatively defining a rectangular display area, the pixels being constituted with a matrix of transparent thin-film transistors (hereafter each respectively "TFT") integrally formed on a glass or quartz substrate, and peripheral drive circuitry composed of a vertical driver for scanning respective gates of the TFTs and (a) horizontal driver(s) for supplying or writing image data to the pixels to display a picture on the display area in accordance with a picture signal.

For use in a multi-media network, it is desirable for an LCD with a predetermined number of matrix-arrayed pixels to be responsible to a picture signal formatted for a different number of pixels, to display a picture reformatted in size to be e.g. contracted or expanded at the LCD.

If the picture signal is formatted for a smaller number of pixels than the predetermined number, a display member of the LCD displays an expanded or non-expanded picture in a corresponding rectangular region (hereafter "picture region"), leaving therearound vertical and/or horizontal blank regions (hereafter collectively "blank region").

In a PROJECTOR or TV, such a blank region is displayed in a so-called "black" color so that one may well cherish an illusion that the blank region did not constitute a display area.

It therefore is necessary for an LCD for multi-media to be adaptive to writing data of a black color to pixels in a blank region thereof, during a blanking period.

FIG. 1 is a circuit diagram of a display member of a conventional LCD.

The conventional LCD comprises a display member composed of a total of 1,024×1,280 matrix-arrayed pixels Px(i, j), and unshown peripheral drive circuitry including a vertical drive circuit connected to the pixels via a total of 1,024 parallel gate scan lines GP-1 to GP-1024 and a horizontal drive circuit connected to the pixels via a total of 1,280 parallel data supplying signal lines DS-1 to DS-1280.

Each pixel Px(i, j) comprises a switching TFT 701 formed on a substrate and connected at a gate electrode thereof to a corresponding scan line GP-i and at a source (or drain) electrode thereof to a corresponding signal line DS-j, a volume of liquid crystal (hereafter sometimes "LC") filled as an LC capacitor 702 between a drain (or source) electrode of the TFT and a counter electrode 703 common to other pixels, and a storage capacitor 704 formed on the substrate for securing a necessary voltage to drive the LC, the capacitor 704 being connected on the side of a transparent ITO electrode to the drain (or source) electrode of the TFT 701 and on the side of a storage capacitor electrode 705 to a corresponding one of non-transparent common-potential conductors arrayed on the substrate, as the electrode 705 forms an integral part of the corresponding common conductor.

FIG. 2 shows timing charts of signals associated with vertical black write actions in blanking periods of the LCD of FIG. 1.

It is now assumed that first 128 and last 128 of the 1,024 rows of pixels need to be displayed in black.

Accordingly, as shown in FIG. 2, corresponding scan lines GP-1~GP-128 and GP-897~GP-1024 are selected in each blanking period, where those pixels Px(i, j) arrayed in the first and last 128 rows (i=1~128 and 897~1,024; j=1~1,280) each have a corresponding data to the black color input thereto from a corresponding signal line DS-j and written therein, so that the storage capacity 704 of the pixel Px(i, j) has a corresponding signal voltage Vpix (i) developed thereacross, which will sometimes be called "pixel voltage".

Assuming an ac driving of the LC, the pixel voltage Vpix(i) in a current blanking period has an opposite polarity to that of a previous or subsequent blanking period.

The written signal Vpix(i) in each selected pixel Px(i, j) has a voltage shift ΔV1 caused therein, as the pixel soon enters a non-selected state, such that:

$$\Delta V1=\delta Vgp\ \{Cgs\div(Cgs+Cst+CLC)\} \quad (1),$$

where (δGgp is a varying voltage as a scan pulse, Cgs is a capacitance between gate and source of a TFT (701 in FIG. 1), Cst is a capacitance of a storage capacity (704 in FIG. 1), and CLC is a capacitance of an LC capacity (702 in FIG. 1).

In an image writing period between an arbitrary pair of neighboring blanking periods, the remaining scan lines GP-129~GP-896 are adequately selected so that those pixels Px(i, j) (i=129~896) arrayed in a picture region of the display member have their image data written therein.

The Japanese Patent Application Laid-Open Publication No. 5-341732 has disclosed a common voltage correction means for correcting such a voltage shift.

Incidentally, the LCD has an opening ratio in terms of a ratio of a transparent area to a total area of a display region of a display member.

As a pixel pitch becomes smaller with a development of LCD miniaturization, the opening ratio will be reduced in due course to an insufficient level, if a total non-transparent area is left as it is. Such a tendency may be conspicuous in the pixel structure described in conjunction with FIG. 1.

Conventionally, to have an improved opening ratio, there has been employed a gate storage structure in which a storage capacitor is formed between a pixel electrode and a gate bus line.

FIG. 3 is a circuit diagram of a display member of an improved conventional LCD with a gate storage structure. Like members are designated with like reference characters.

In FIG. 3, at each pixel Px(i, j), a storage capacitor 604 is formed between a drain (or source) electrode of a TFT 601 and a gate drive bus as a common scan line GP-(i−1) to pixels Px(i−1, j) in a one-upper row. For pixels Px(1, j) in a 1-th row, a 0-th common bus GP-0 is provided for supplying a common potential to corresponding storage capacitors. Designated at referernce character 602 is an LC capacitor, and 603 is a counter electrode.

The gate storage structure of FIG. 3 needs no dedicated conductors (705 in FIG. 1) for supplying the common potential to respective storage capacitors, and permits a remarkably improved opening ratio.

FIG. 4 shows timing charts of signals associated with vertical black write actions in blanking periods of the LCD of FIG. 3.

It is again assumed that first 128 and last 128 of a total of 1,024 rows of pixels need to be displayed in black.

Accordingly, as shown in FIG. 4, when those scan lines GP-1~GP-128 and GP-897~GP-1024 selected in each blanking period are released from the selection, the pixels Px(1, j) of the 1-th row each have a voltage shift ΔV1 caused in a pixel voltage Vpix(1) thereof, which voltage shift ΔV1 is representable by the experssion (1).

However, in those pixels Px(i, j) (i=2~128 and 897 ~1,204) arrayed in 2-th~128-th and 897-th ~1,204-th rows, their pixel voltages Vpix (i) each have a voltage shift ΔV2 caused therein in dependence on a combination of a capacitance Cgs between gate and source of the TFT 601, a storage capacitance Cst between a pixel electrode and a gate bus line, and an LC capacitance CLC, i.e. due to a capacitive coupling between a pixel electrode and a neighboring bus line, such that:

$$\Delta V2=\delta Ggp\times\{(Cgs+Cst)\div(Cgs+Cst+CLC)\} \quad (2).$$

In the expression (2), the storage capacitance Cst usually is larger than the LC capacitance CLC times three, or equivalent to the gate-source capacitance Cgs times 20~50. As a result, the voltage shift ΔV2 tends to exceed 10 volts, i.e. it may be greatly larger than ΔV1.

To this point, at pixels Px(i, j) (i=129~896), their pixel voltages Vpix(129~896) each have a voltage shift substantially equivalent to ΔV1.

Therefore, the conventional LCD of FIG. 3 tends to suffer from a degraded image quality due to a large difference between a voltage shift in black write actions and that in image write actions, if the conventional driving method shown in FIG. 4 is applied.

The present invention has been achieved with such points in mind.

SUMMARY OF THE INVENTION

It therefore is an object of the present invention to provide a driving method for an LCD of a gate storage structure having a high opening ratio, permitting a competent image quality to be secured with a stable high contrast.

To achieve the object, a genus of the present invention provides a driving method for a liquid crystal display including a plurlaity of scan lines, a plurality of signal lines crossing the scan lines, and a matrix of pixels having switching elements and storage capacitors thereof connected between the scan and signal line. The driving method comprises the steps of selecting one of neighboring two of the scan lines for a black write action of an arbitrary one of the signal lines in a blanking period, and selecting the other of the neighboring two scan lines for another black write action of the arbitrary signal line in the blanking period.

According to the genus of the invention, an odd-numbered scan line and an even-numbered scan line are permitted to alternatively have a common potential so that in those pixels connected to a selected scan line their pixel voltages may undergo a relatively small voltage shift free from the adverse effect of a capacitive coupling.

According to a species of the genus of the invention, said black write action is differernt in phase from said another black write action.

According to another species of the genus of the invention, said black write action writes a black data with a polarity different from a polarity of a black data to be written by said another black write action.

Further, to achieve the object, another genus of the present invention provides a driving method for a liquid crystal display including a plurlaity of scan lines, a plurality of signal lines crossing the scan lines, and a matrix of pixels having switching elements and storage capacitors thereof connected between the scan and signal lines. The driving method comprises the steps of selecting one of neighboring two of the scan lines for a black write action of an arbitrary one of the signal lines in one of a pair of neighboring blanking periods, and selecting the other of the neighboring two scan lines for another black write action of the arbitrary signal line in the other blanking period.

According to this genus of the invention, in an interlacing scan mode, an odd-numbered scan line and an even-numbered scan line are permitted to alternatively have a common potential so that in those pixels connected to a selected scan line their pixel voltages may undergo a relatively small voltage shift free from the adverse effect of a capacitive coulping.

According to a species of this genus of the invention, the black write action writes a black data with a polarity different from a polarity of a black data to be written by said another black write action.

BRIEF DESCRIPTION OF THE DRAWINGS

The objects, features and advantages of the present invention will become more apparent from consideration of the following detailed description, in conjunction with the accompanying drawings, in which.

DESCRIPTION OF THE PREFERRED EMBODIMENTS

Figure 1:
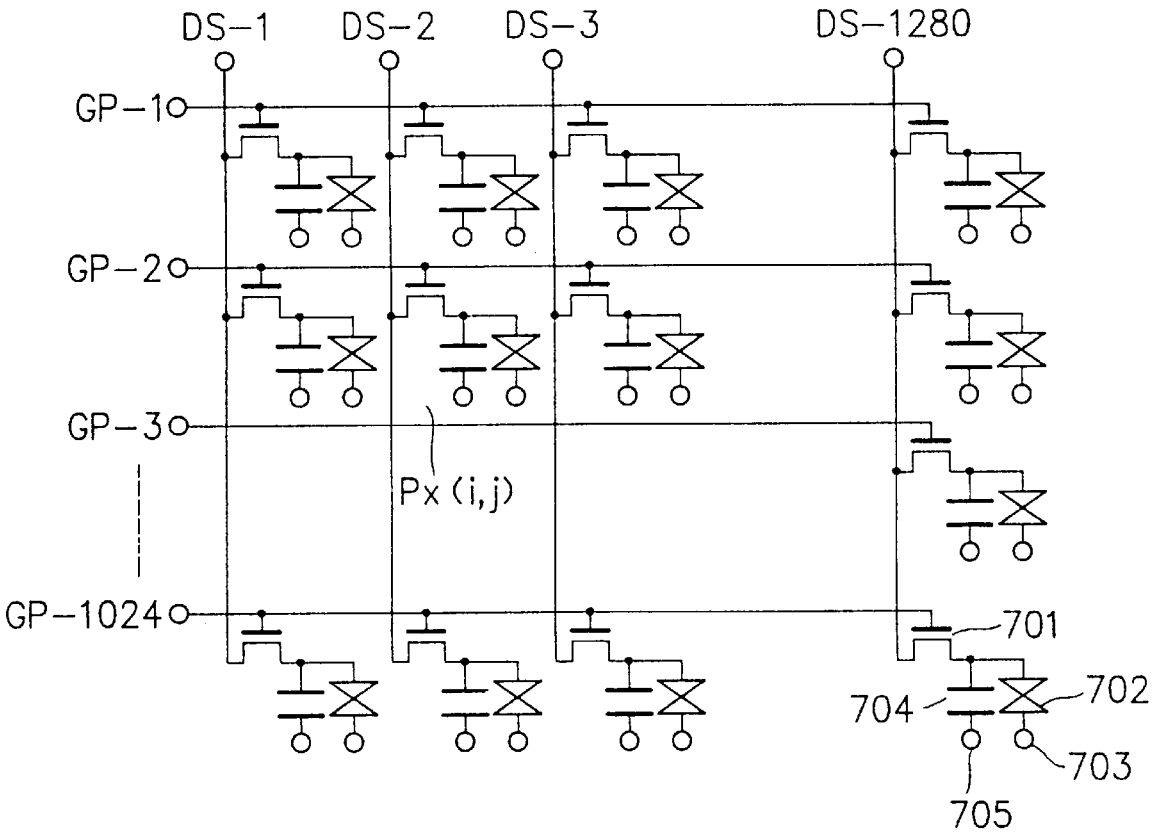
FIG. 1 PRIOR ART
FIG. 1 is a circuit diagram of a display member of a conventional LCD.
Figure 2:
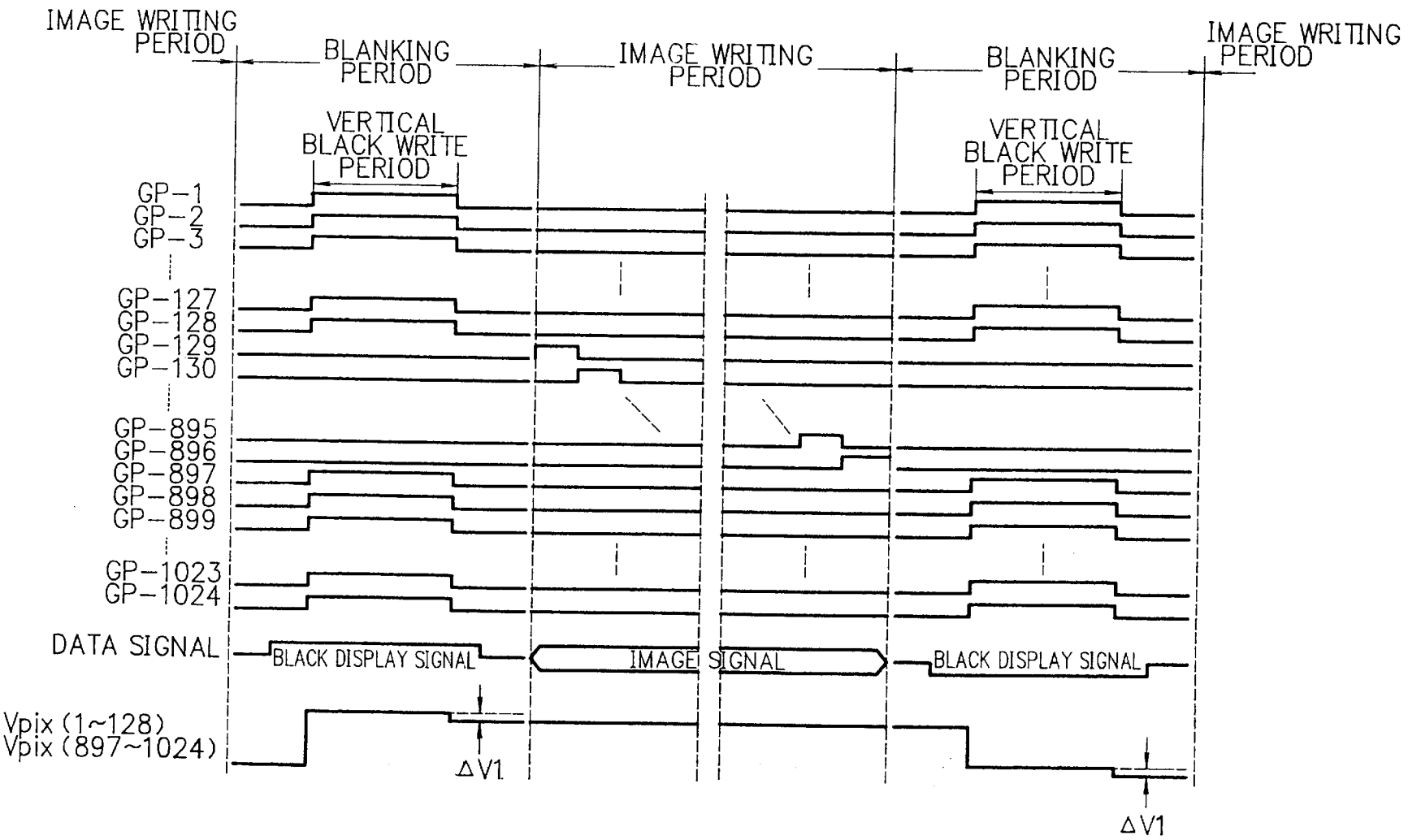
FIG. 2 PRIOR ART
FIG. 2 shows timing charts of signals associated with vertical black write actions in blanking periods of the LCD of FIG. 1.

There will be detailed below preferred embodiments of the present invention, with reference to the drawings. Like members are designated by like reference characters.

Figure 3:
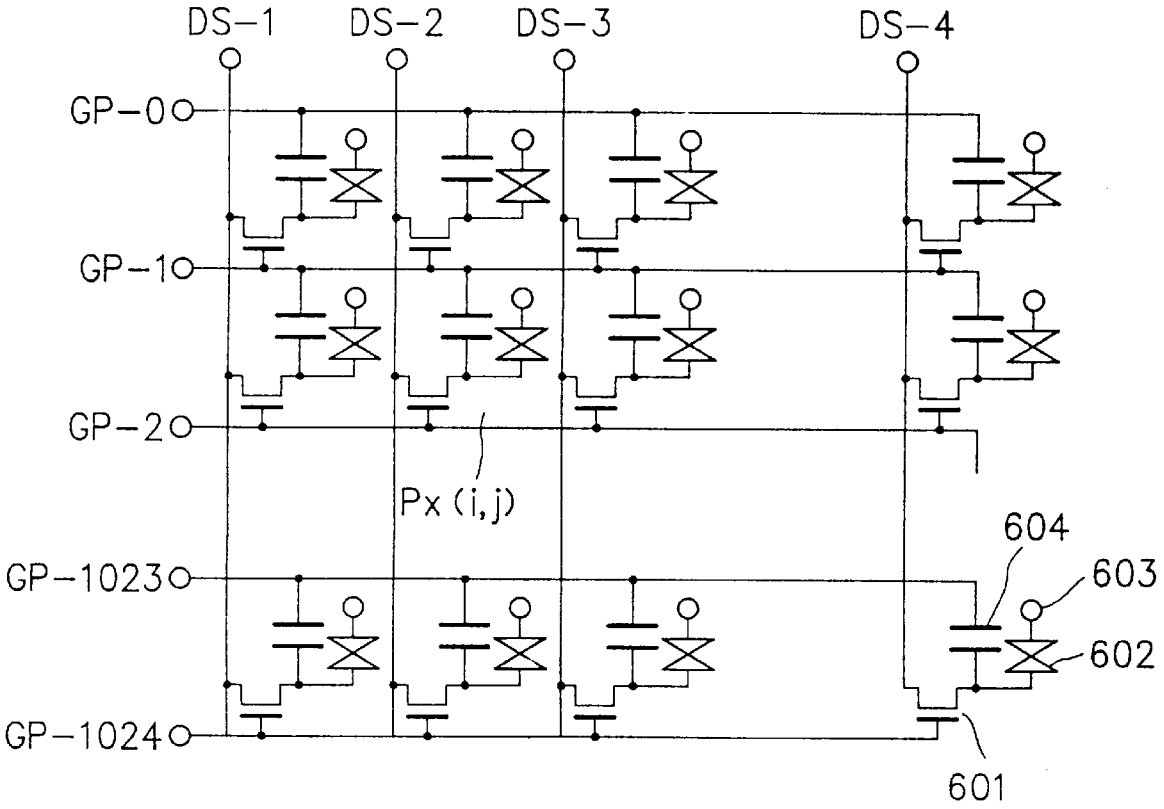
FIG. 3 PRIOR ART
FIG. 3 is a circuit diagram of a display member of an improved conventional LCD.
Figure 4:
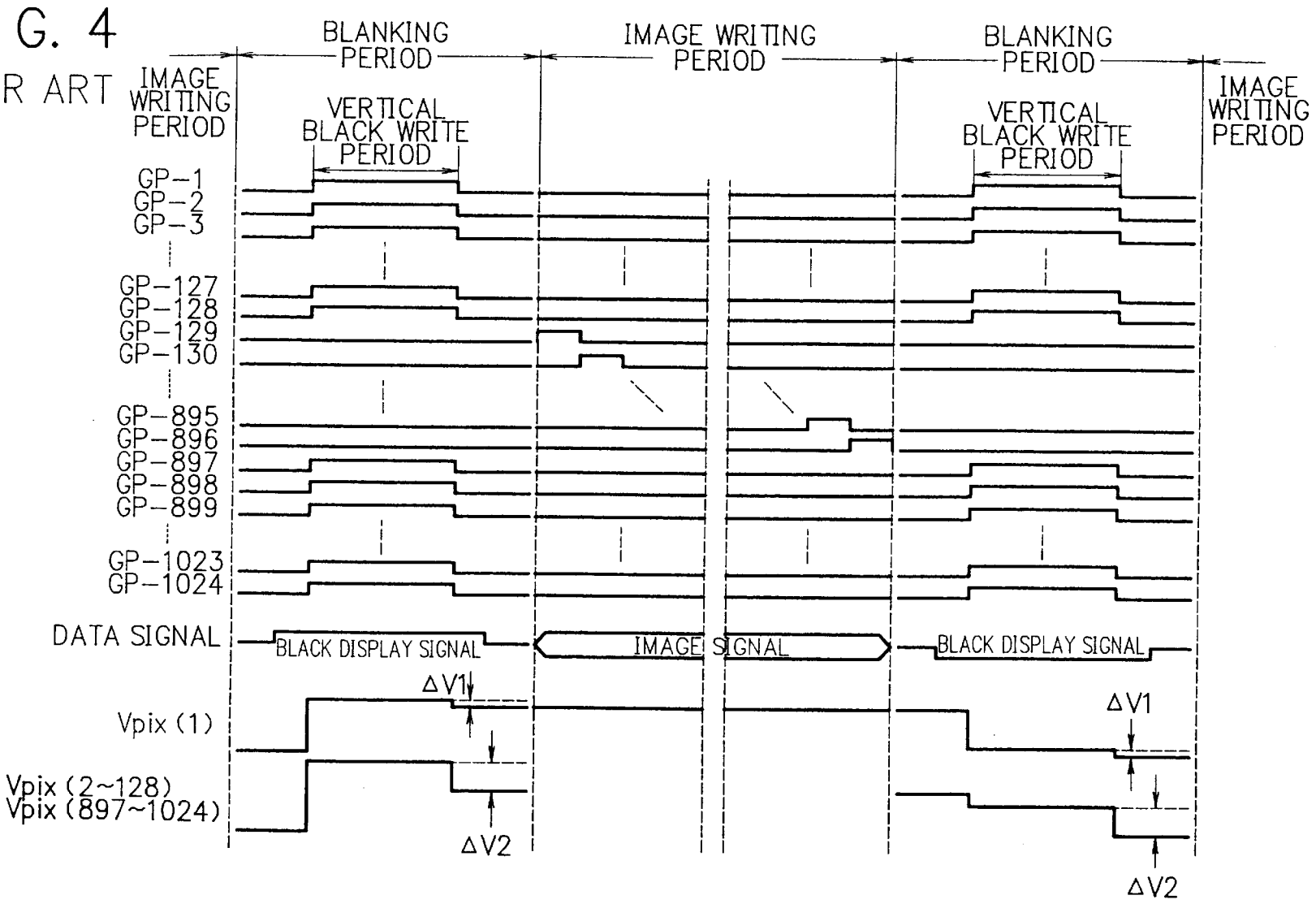
FIG. 4 PRIOR ART
FIG. 4 shows timing charts of signals associated with vertical black write actions in blanking periods of the LCD of FIG. 3.
Figure 5:
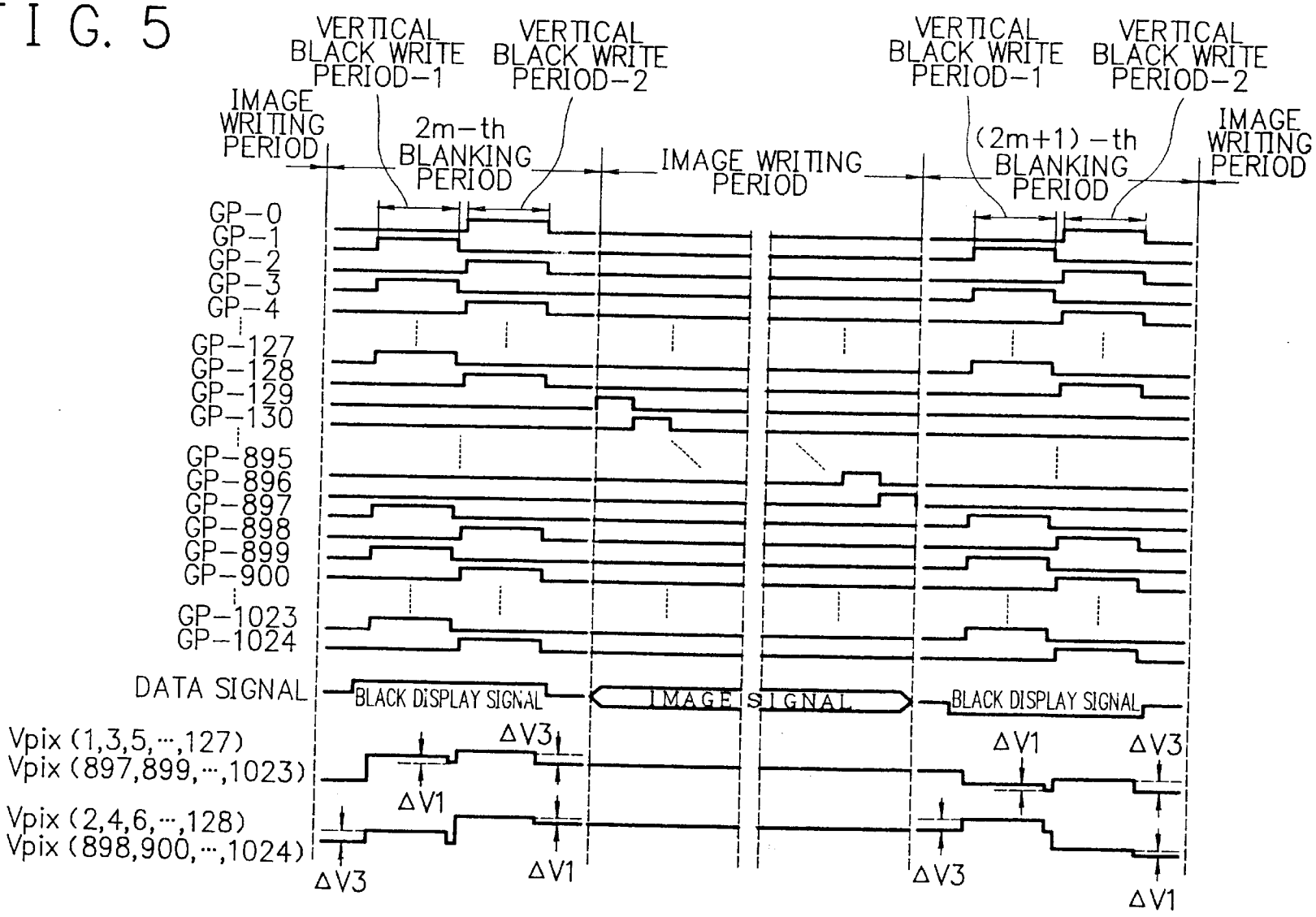
FIG. 5 shows timing charts of signals associated with vertical black write actions according to an embodiment of the invention.

FIG. 5 shows timing charts of signals associated with vertical black write actions to be performed in blanking periods of the LCD of FIG. 3, in accordance with an embodiment of the invention, which is adaptive for an image display driving by a signal written with a polarity reversed every field or every frame.

It is still assumed that first 128 and last 128 of a total of 1,024 rows of pixels need to be displayed in black.

As shown in FIG. 5, during a vertical black write period-1 in a 2m-th or (2m+1)-th blanking period, where m is an arbitrary integer, among scan lines GP-1~GP-128 and GP-897~GP-1024 corresponding to those pixels Px(i, j) (i=1~128 and 897~1,024) to be displayed in black, odd-numbered ones GP-1, GP-3, GP-5, . . . , GP-127 and GP-897, GP-899, GP-901, . . . , GP-1023 [i.e. GP-i (i=2n−1; n=1~64 and 449~512] are selected, when the signal lines DS-j (j=1~1,280) input a black data with a polarity (positive in the 2m-th blanking period and negative in the (2m+1)-th blanking period of the FIG. 5) to corresponding pixels Px(i, j) (i=2n−1; n=1~64 and 449~512), where it is written.

At the pixels Px(i, j) (i=2n−1; n=1~64 and 449~512) with the black data written, their pixel voltages Vpix(1), Vpix(3), Vpix(5), . . . , Vpix(127) and Vpix(897), Vpix(899), Vpix(901), . . . , Vpix(1023) [i.e. Vpix(2n−1) (n=1~64 and 449~512)] each have a voltage shift ΔV1 caused therein in accordance with the expression (1), when the odd-numbered scan lines GP-i (i=2n−1; n=1~64 and 449~512) each go out from the selected state to a non-selected state.

At that time, even-numbered scan lines GP-i (i=2n; n=1~512) each have a common voltage as well as the 0-th bus line GP-0, which voltage corresponds to a storage capacitor electrode voltage of the pixels Px(i, j) (i=2n−1; n =1~512) so that the voltage shift ΔV1 is free from the adverse effect of a capacitive coupling.

In this respect, at respective pixels Px(i, j) (i=2n; n=1~64 and 449~512) of which TFTs are connected to the even-numbered scan lines GP-i (i=2n; n=1~512), their pixel voltages Vpix(2), Vpix(4), Vpix(6), . . . , Vpix(128) and Vpix(898), Vpix(900), Vpix(902), . . . , Vpix(1024) [i.e. Vpix(2n) (n=1~64 and 449~512)] each have a voltage shift ΔV3 caused therein, such that, $$\Delta V3=\delta VGP\ \{CST\div(Cgs+Cst+CLC)\} \tag{3}$$

when the odd-numbered scan lines GP-i (i=2n−1; n=1~64 and 449~512) each enter from a non-selected state to a selected state, as well as when going out from the selected state to a non-selected state.

In other words, the pixel voltage Vpix(i) (i=2n; n =1~64 and 449~512) at each pixel in even-numbered rows is shifted in a (rise) direction by a voltage ΔV3 at a start time of each black write period-1, in which pixels in odd-numbered rows have a black data written therein, and in an opposite (fall) direction by the same voltage ΔV3 at an end time of the period-1, so that it has an identical level before and after the period-1.

Moreover, as shown in FIG. 5, during a vertical black write period-2 in the same blanking period, among the scan lines GP-1~GP-128 and GP-897~GP-1024 corresponding to the pixels Px(i, j) (i=1~128 and 897~1,024) to be displayed in black, even-numbered ones GP-2, GP-4, GP-6, . . . , GP-128 and GP-898, GP-900, GP-902, . . . , GP-1024 [i.e. GP-i (i=2n; n=1 ~64 and 449~512] are selected, while the black data is kept supplied from the signal lines DS-j (i=1~1,280) so that they are input to corresponding pixels Px(i, j) (i=2n; n=1 ~64 and 449~512), where it is written.

At the pixels Px(i, j) (i=2n; n=1~64 and 449~512) with the black data written, their pixel voltages Vpix(2), Vpix(4), Vpix(6), . . . , Vpix(128) and Vpix(898), Vpix(900), Vpix (902), . . . , Vpix(1024) [i.e. Vpix(2n) (n=1~64 and 449~512)] each have a voltage shift ΔV1 caused therein in accordance with the expression (1), when the even-numbered scan lines GP-i (i=2n; n=1~64 and 449~512) each go out from the selected state to a non-selected state.

At that time, odd-numbered scan lines GP-i (i=2n−1; n=1~512) each have a common voltage, which voltage corresponds to a storage capacitor electrode voltage of the pixels Px(i, j) (i=2n; n=1~512) so that the voltage shift ΔV1 is free from the adverse effects of a capacitive coupling.

In this respect, at respective pixels Px(i, j) (i=2n—1; n=1~64 and 449~512) of which TFTs are connected to the odd-numbered scan lines GP-i (i=2n−1; n=1~512), their pixel voltages Vpix(1), Vpix(3), Vpix(5), . . ., Vpix(127) and Vpix(897), Vpix(899), Vpix(901), . . . , Vpix(1023) [i.e. Vpix(2n−1) (n=1~64 and 449~512)] each have a voltage shift ΔV3 caused therein in accordance with the expression (3), when the even-numbered scan lines GP-i (i=2n; n=1~64 and 449~512) and the bus line GP-0 each enter from a non-selected state to a selected state, as well as when going out from the selected state to a non-selected state.

In other words, the pixel voltage Vpix(i) (i=2n−1; n=1~64 and 449~512) at each pixel in odd-numbered rows is shifted in a (rise) direction by a voltage ΔV3 at a start time of each black write period-2, in which pixels in even-numbered rows have a black data written therein, and in an opposite (fall) direction by the same voltage ΔV3 at an end time of the period-2, so that it has an identical level before and after the period-2.

As a result, at respective lines to be displayed in black, each pixel voltage for the black display has an idential voltage shift ΔV1 caused therein when a corresponding scan line goes out from a selected state to a non-selected state, whether it is odd-numbered or even-numbered, whereas the pixel voltages in any current blanking period are opposite in polarity to those in a previous or subsequent blanking period becuase of the ac driving.

In an image writing period between an arbitrary pair of neighboring blanking periods, the remaining scan lines GP-129~GP-896 are sequentially selected so that those pixels Px(i, j) (i=129~896) arrayed in a picture region of the display member have their image data written therein with a polarity reversed every field or every frame.

In the image writing period, each pixel voltage for the image display has a voltage shift ΔV1 caused therein when a corresponding scan line goes out from a selected state to a non-selected state, which voltage shift is identical to the voltage shift ΔV1 for the black display. Accordingly, an identical voltage shift is caused all over the display region, permitting a competent image quality to be achieved.

Therefore, the LCD of a gate storage struture is adapted for a desirable vertical black write action to be performed with a polarity reversed every field or frame.

Figure 6:
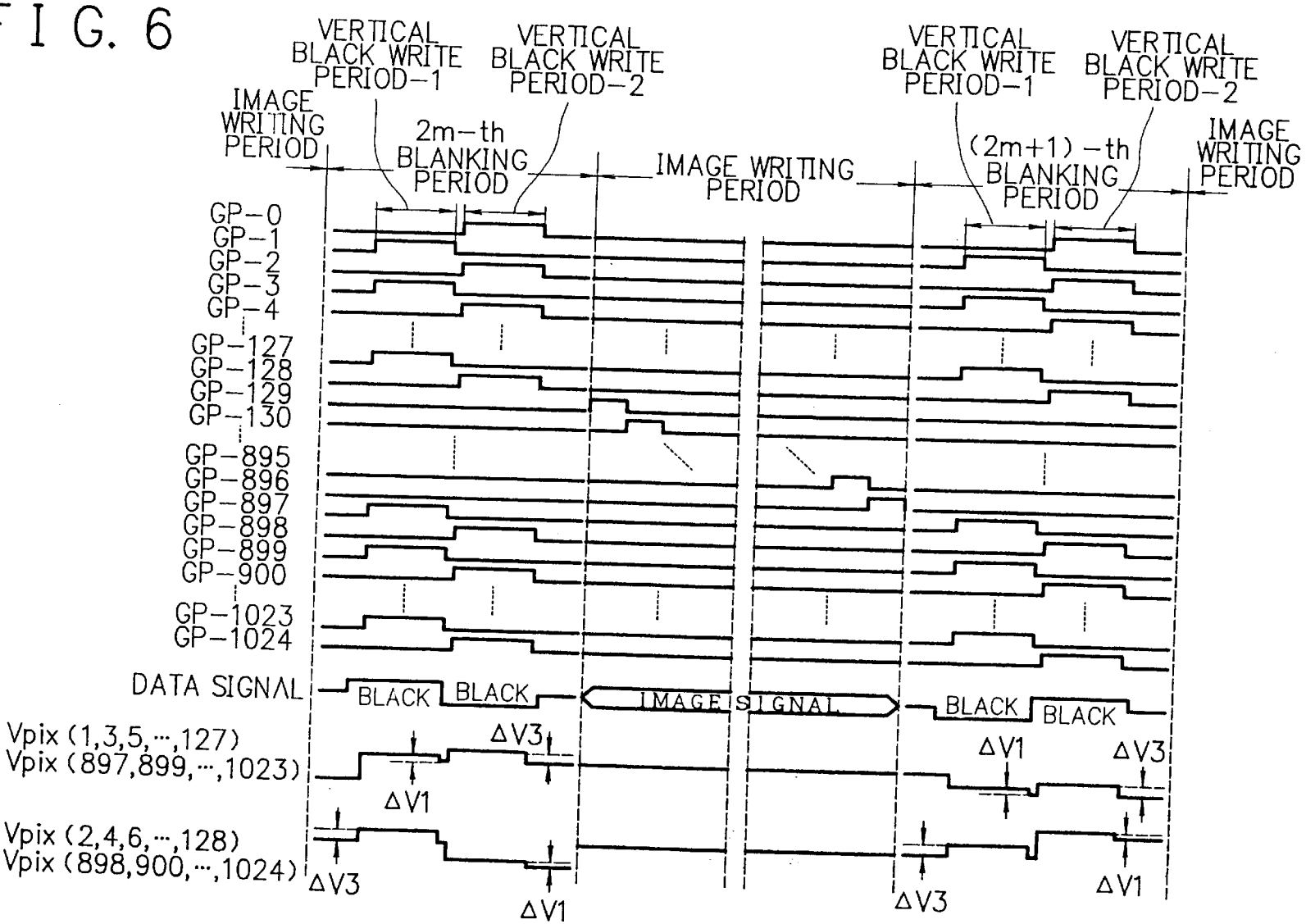
FIG. 6 shows timing charts of signals associated with vertical black write actions according to another embodiment of the invention.

FIG. 6 shows timing charts of signals associated with vertical black write actions to be performed in blanking periods of the LCD of FIG. 3, in accordance with an embodiment of the invention in which, in each blanking period, a black data signal written in pixels of odd number rows is different in polarity from that written in pixels of even number rows and, between neighboring blanking periods, the black data signals are both reversed in polarity. This embodiment is adaptive for an image display driving by a signal written with a polarity reversed every line.

It is still assumed that first 128 and last 128 of a total of 1,024 rows of pixels need to be displayed in black.

As shown in FIG. 6, during a vertical black write period-1 in an 2m-th or (2m+1)-th blanking period, among scan lines GP-1~GP-128 and GP-897~GP-1024 corresponding to those pixels Px(i, j) (i=1~128 and 897~1,024) to be displayed in black, odd-numbered ones GP-1, GP-3, GP-5, . . . , GP-127 and GP-897, GP-899, GP-901, . . . , GP-1023 [i.e. GP-i (i=2n−1; n=1~64 and 449~512] are selected, when the signal lines DS-j (j=1~1,280) input a black data, with a positive polarity in the 2m-th blanking period or a negative polarity in the (2m+1)-th blanking period, to corresponding pixels Px(i, j) (i=2n−1; n=1~64 and 449~512), where it is written.

At the pixels Px(i, j) (i=2n−1; n=1~64 and 449~512) with the positive or negative black data written, their pixel voltages Vpix(1), Vpix(3), Vpix(5), . . . , Vpix(127) and Vpix(897), Vpix(899), Vpix(901), . . . , Vpix(1023) [i.e. Vpix(2n−1) (n=1~64 and 449~512)] each have a voltage shift ΔV1 caused therein in accordance with the expression (1), when the odd-numbered scan lines GP-i (i=2n−1; n=1~64 and 449 ~512) each go out from the selected state to a non-selected state.

At that time, even-numbered scan lines GP-i (i=2n; n=1~512) each have a common voltage as well as the 0-th bus line GP-0, which voltage corresponds to a storage capacitor electrode voltage of the pixels Px(i, j) (i=2n−1; n =1~512) so that the voltage shift ΔV1 is free from the adverse effect of a capacitive coupling.

In this respect, at respective pixels Px(i, j) (i=2n; n=1~64 and 449~512) of which TFTs are connected to the even-numbered scan lines GP-i (i=2n; n=1~512), their pixel voltages Vpix(2), Vpix(4), Vpix(6), . . . , Vpix(128) and Vpix(898), Vpix(900), Vpix(902), . . . , Vpix(1024) [i.e. Vpix(2n) (n=1~64 and 449~512)] each have a voltage shift ΔV3 caused therein in accordance with the expression (3), when the even-numbered scan lines GP-i (i=2n−1; n=1~64 and 449 ~512) each enter from a non-selected state to a selected state, as well as when going out from the selected state to a non-selected state.

In other words, the pixel voltage Vpix(i) (i=2n; n =1~64 and 449~512) at each pixel in even-numbered rows is shifted in a (rise) direction by a voltage ΔV3 at a start time of each black write period-1, in which pixels in odd-numbered rows have a black data written therein, and in an opposite (fall) direction by the same voltage ΔV3 at an end time of the period-1, so that it has an identical level before and after the period-1.

Moreover, as shown in FIG. 6, during a vertical black write period-2 in the same blanking period, among the scan lines GP-1~GP-128 and GP-897~GP-1024 corresponding to the pixels Px(i, j) (i=1~128 and 897~1,024) to be displayed in black, even-numbered ones GP-2, GP-4, GP-6, . . . , GP-128 and GP-898, GP-900, GP-902, . . . , GP-1024 [i.e. GP-i (i=2n; n=1 ~64 and 449~512)] are selected, when the signal lines DS-j (j=1~1,280) input a black data, with a negative polarity in the 2m-th blanking period or a positive polarity in the (2m+1)-th blanking period, to corresponding pixels Px(i, j) (i =2n; n=1~64 and 449~512), where it is written.

At the pixels Px(i, j) (i=2n; n=1~64 and 449~512) with the black data written, their pixel voltages Vpix(2), Vpix(4), Vpix(6), . . . , Vpix(128) and Vpix(898), Vpix(900), Vpix (902), . . . , Vpix(1024) [i.e. Vpix(2n) (n=1~64 and 449~512)] each have a voltage shift ΔV1 caused therein in accordance with the expression (1), when the even-numbered scan lines GP-i (i=2n; n=1~64 and 449~512) each go out from the selected state to a non-selected state.

At that time, odd-numbered scan lines GP-i (i=2n−1; n=1−512) each have a common voltage, which voltage corresponds to a storage capacitor electrode voltage of the pixels Px(i, j) (i=2n; n=1~512) so that the voltage shift ΔV1 is free from the adverse effect of a capacitive coupling.

In this respect, at respective pixels Px(i, j) (i=2n−1; n=1~64 and 449~512) of which TFTs are connected to the odd-numbered scan lines GP-i (i=2n−1; n=1~512), their pixel voltages Vpix(1), Vpix(3), Vpix(5), . . . , Vpix(127) and Vpix(897), Vpix(899), Vpix(901), . . . , Vpix(1023) [i.e. Vpix(2n−1) (n=1~64 and 449~512)] each have a voltage shift ΔV3 caused therein in accordance with the expression (3), when the even-numbered scan lines GP-i (i=2n; n=1~64 and 449~512) and the bus line GP-0 each enter from a non-selected state to a selected state, as well as when going out from the selected state to a non-selected state.

In other words, the pixel voltage Vpix(i) (i=2n−1; n=1~64 and 449~512) at each pixel in odd-numbered rows is shifted in a (rise) direction by a voltage ΔV3 at a start time of each black write period-2, in which pixels in even-numbered rows have a black data written therein, and in an opposite (fall) direction by the same voltage ΔV3 at an end time of the period-2, so that it has an identical level before and after the period-2.

As a result, at respective lines to be displayed in black, each pixel voltage for the black display has an idential voltage shift ΔV1 caused therein when a corresponding scan line goes out from a selected state to a non-selected state, whether it is odd-numbered or even-numbered, whereas the pixel voltages in any current blanking period are opposite in polarity to those in a previous or subsequent blanking period becuase of the ac driving, that is, as shown in FIG. 6, the black display signal has a positive polarity in a Period-1 of a 2m-th blanking period and a period-2 of a (2m+1)-th blanking period and a negative polarity in a period-2 of the 2m-th blanking period and a period-1 of the (2m+1)-th blanking period.

In an image writing period between an arbitrary pair of neighboring blanking periods, the remaining scan lines GP-129–GP-896 are sequentially selected so that those pixels Px(i, j) (i=129~896) arrayed in a picture region of the display member have their image data written therein with a polarity reversed every line.

In the image writing period, each pixel voltage for the image display has a voltage shift ΔV1 caused therein when a corresponding scan line goes out from a selected state to a non-selected state, which voltage shift is identical to the voltage shift ΔV1 for the black display. Accordingly, an identical voltage shift is caused all over the display region, permitting a competent image quality to be achieved.

Therefore, the LCD of a gate storage struture is adapted for a desirable vertical black write action to be performed with a polarity reversed every line.

Figure 7:
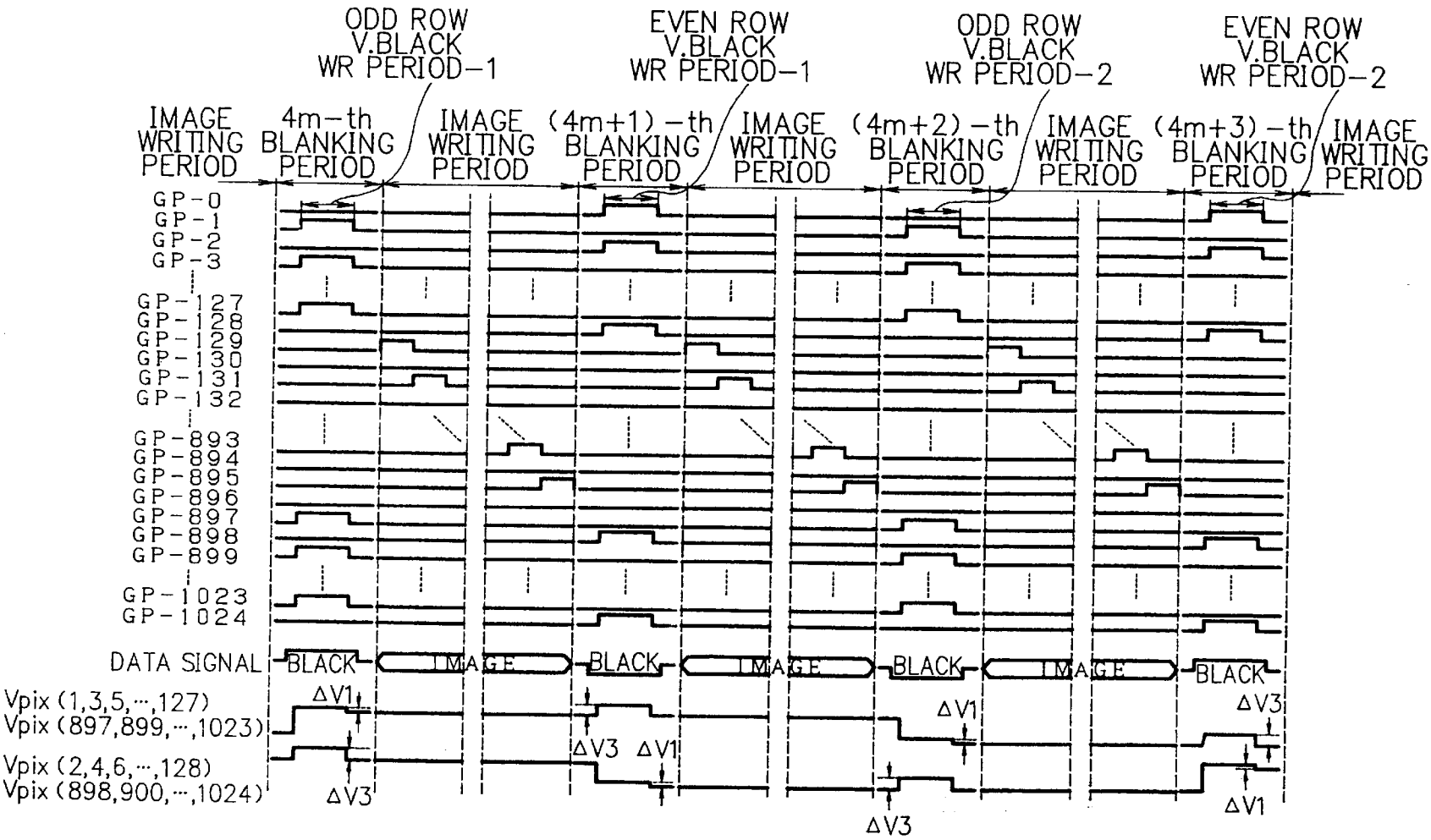
FIG. 7 shows timing charts of signals associated with vertical black write actions according to another embodiment of the invention.

FIG. 7 shows timing charts of signals associated with vertical black write actions to be performed in blanking periods of the LCD of FIG. 3, as it is scanned in an interlacing manner, in accordance with an embodiment of the invention in which at each odd-numbered line to be displayed in black, as well as at each even-numbered line to be displayed in black, a black data is written every other field.

It is assumed that first 128 and last 128 of a total of 1,024 rows of pixels need to be displayed in black.

As shown in FIG. 7, during a vertical black write period-1 at a 4m-th blanking period, among scan lines GP-1~GP-128 and GP-897~GP-1024 corresponding to those pixels Px(i, j) (i=1~128 and 897~1,024) to be displayed in black, odd-numbered ones GP-1, GP-3, GP-5, . . . , GP-127 and GP-897, GP-899, GP-901, . . . , GP-1023 [i.e. GP-i (i=2n−1; n=1~64 and 449~512)] are selected, when the signal lines DS-j (j=1~1,280) input a black data with a positive polarity to corresponding pixels Px(i, j) (i=2n−1; n=1~64 and 449~512), where it is written.

At the pixels Px(i, j) (i=2n−1; n=1~64 and 449~ 512) with the positive black data written, their pixel voltages Vpix(1), Vpix(3), Vpix(5), . . . , Vpix(127) and Vpix(897), Vpix(899), Vpix(901), . . . , Vpix(1023) [i.e. Vpix(2n−1) (n=1~64 and 449~512)] each have a voltage shift ΔV1 caused therein in accordance with the expression (1), when the odd-numbered scan lines GP-i (i=2n−1; n=1~64 and 449 ~512) each go out from the selected state to a non-selected state.

At that time, even-numbered scan lines GP-i (i=2n; n=1~512) each have a common voltage as well as the 0-th bus line GP-0, which voltage corresponds to a storage capacitor electrode voltage of the pixels Px(i, j) (i=2n−1; n =1~512) so that the voltage shift ΔV1 is free from the adverse effect of a capacitive coupling.

In this respect, at respective pixels Px(i, j) (i=2n; n=1~64 and 449~512) of which TFTs are connected to the even-numbered scan lines GP-i (i=2n; n=1~512), their pixel voltages Vpix(2), Vpix(4), Vpix(6), . . . , Vpix(128) and Vpix(898), Vpix(900), Vpix(902), . . . , Vpix(1024) [i.e. Vpix(2n) (n=1~64 and 449~512)] each have a voltage shift ΔV3 caused therein in accordance with the expression (3), when the odd-numbered scan lines GP-i (i=2n−1; n=1~64 and 449 ~512) each enter from a non-selected state to a selected state, as well as when going out from the selected state to a non-selected state.

In other words, in the 4m-th blanking period, the pixel voltage Vpix(i) (i=2n; n=1~64 and 449~512) at each pixel in even-numbered rows is shifted in a (rise) direction by a voltage ΔV3 at a start time of the black write period-1 in which pixels in odd-numbered rows have a black data written therein, and in an opposite (fall) direction by the same voltage ΔV3 at an end time of this period-1, so that it has an identical level before and after the concerned period-1.

In an image writing period following the 4m-th blanking period, odd-numbered ones GP-i (i=2n−1; n=65~448) of the remaining scan lines GP-i (i=129~896) are sequantially selected so that corresponding pixels Px(i, j) (i =2n−1; n=65~448) have image data stored therein with a positive polarity.

Moreover, as shown in FIG. 7, during a vertical black write period-1 at a (4m+1)-th blanking period following the image writing period, among the scan lines GP-1~GP-128 and GP-897~GP-1024 corresponding to the pixels Px(i, j) (i=1~128 and 897~1,024) to be displayed in black, even-numbered ones GP-2, GP-4, GP-6, . . . , GP-128 and GP-898, GP-900, GP-902, . . . , GP-1024 [i.e. GP-i (i=2n; n=1~64 and 449~512)] are selected, when the signal lines DS-j (i=1~1,280) input a black data with a negative polarity, i.e. with an opposite polarity to the black data in the previous period-1, to corresponding pixels Px(i, j) (i=2n; n=1~64 and 449~512), where it is written.

At the pixels Px(i, j) (i=2n; n=1~64 and 449~512) with the black data written, their pixel voltages Vpix(2), Vpix(4), Vpix(6), . . . , Vpix(128) and Vpix(898), Vpix(900), Vpix (902), . . . , Vpix(1024) [i.e. Vpix(2n) (n=1~64 and 449~512)] each have a voltage shift ΔV1 caused therein in accordance with the expression (1), when the even-numbered scan lines GP-i (i=2n; n=1~64 and 449~512) each go out from the selected state to a non-selected state.

At that time, odd-numbered scan lines GP-i (i=2n−1; n=1~512) each have a common voltage, which voltage corresponds to a storage capacitor electrode voltage of the pixels Px(i, j) (i=2n; n=1~512) so that the voltage shift ΔV1 is free from the adverse effect of a capacitive coupling.

In this respect, at respective pixels Px(i, j) (i=2n−1; n=1~64 and 449~512) of which TFTs are connected to the odd-numbered scan lines GP-i (i=2n−1; n=1~512), their pixel voltages Vpix(1), Vpix(3), Vpix(5), . . . , Vpix(127) and Vpix(897), Vpix(899), Vpix(901), . . . , Vpix(1023) [i.e. Vpix(2n−1) (n=1~64 and 449~512)] each have a voltage shift ΔV3 caused therein in accordance with the expression (3), when the even-numbered scan lines GP-i (i=2n; n=1~64 and 449~512) and the bus line GP-0 each enter from a non-selected state to a selected state, as well as when going out from the selected state to a non-selected state.

In other words, in the (4m+1)-th blanking period, the pixel voltage Vpix(i) (i=2n−1; n=1~64 and 449~512) at each pixel in odd-numbered rows is shifted in a (rise) direction by a voltage ΔV3 at a start time of the black write period-1 in which pixels in even-numbered rows have a black data written therein, and in an opposite (fall) direction by the same voltage ΔV3 at an end time of this period-1, so that it has an identical level before and after the concerned period-1.

In an image writing period following the (4m+1)-th blanking period, even-numbered ones GP-i (i=2n; n=65~448) of the scan lines GP-i (i=129~896) in the picture region are sequantially selected so that corresponding pixels Px(i, j) (i=2n; n=65~448) have image data stored therein with a negative polarity.

Still more, as shown in FIG. 7, during a vertical black write period-2 at a (4m+2)-th blanking period following this image writing period, among the scan lines GP-1~GP-128 and GP-897~GP-1024 corresponding to the pixels Px(i, j) (i=1~128 and 897~1,024) to be displayed in black, odd-numbered ones GP-1, GP-3, GP-5, . . . , GP-127 and GP-897, GP-899, GP-901, . . . , GP-1023 [i.e. GP-i (i=2n−1; n=1~64 and 449~512)] are selected, when the signal lines DS-j (i=1~1,280) input a black data with a negative polarity, i.e. with a polarity of the black data in the previous period-1 for even-numbered rows, to corresponding pixels Px(i, j) (i=2n; n=1 ~64 and 449~512), where it is written.

At the pixels Px(i, j) (i=2n−1; n=1~64 and 449~512) with the black data written, their pixel voltages Vpix(1), Vpix(3), Vpix(5), . . . , Vpix(127) and Vpix(897), Vpix(899), Vpix (901), . . . , Vpix(1023) [i.e. Vpix(2n−1) (n=1~64 and 449~512)] each have a voltage shift ΔV1 caused therein in accordance with the expression (1), when the odd-numbered scan lines GP-i (i=2n−1; n=1~64 and 449~512) each go out from the selected state to a non-selected state.

At that time, even-numbered scan lines GP-i (i=2n; n=1~512) each have a common voltage, which voltage corresponds to a storage capacitor electrode voltage of the pixels Px(i, j) (i=2n−1; n=1~512) so that the voltage shift ΔV1 is free from the adverse effect of a capacitive coupling.

In this respect, at respective pixels Px(i, j) (i=2n; n=1~64 and 449~512) of which TFTs are connected to the even-numbered scan lines GP-i (i=2n; n=1~64 and 449~512), their pixel voltages Vpix(1), Vpix(3), Vpix(5), . . . , Vpix (127) and Vpix(897), Vpix(899), Vpix(901), . . . , Vpix (1023) [i.e. Vpix(2n−1) (n=1~64 and 449~512)] each have a voltage shift ΔV3 caused therein in accordance with the expression (3), when the odd-numbered scan lines GP-i (i=2n−1; n=1~64 and 449~512) each enter from a non-selected state to a selected state, as well as when going out from the selected state to a non-selected state.

In other words, the pixel voltage Vpix(i) (i=2n; n =1~64 and 449~512) at each pixel in even-numbered rows is shifted in a (rise) direction by a voltage ΔV3 at a start time of the black write period-2 in which pixels in even-numbered rows have a black data written therein, and in an opposite (fall) direction by the same voltage ΔV3 at an end time of this period-2, so that it has an identical level before and after the concerned period-2.

In an image writing period following the (4m+2)-th blanking period, odd-numbered ones GP-i (i=2n−1; n=65~448) of the scan lines GP-i (i=129~896) in the picture region are sequantially selected so that corresponding pixels Px(i, j) (i=2n−1; n=65~448) have image data stored therein with a negative polarity.

Yet more, as shown in FIG. 7, during a vertical black write period-1 at a (4m+3)-th blanking period following this image writing period, among the scan lines GP-1~GP-128 and GP-897~GP-1024 corresponding to the pixels Px(i, j) (i=1~128 and 897~1,024) to be displayed in black, even-numbered ones GP-2, GP-4, GP-6, . . . , GP-128 and GP-898, GP-900, GP-902, . . . , GP-1024 [i.e. GP-i (i=2n; n=1~64 and 449~512)] are selected, when the signal lines DS-j (i=1~1,280) input a black data with a positive polarity, i.e. with an opposite polarity to the black data in the previous period-2, to corresponding pixels Px(i, j) (i=2n; n=1~64 and 449~512), where it is written.

At the pixels Px(i, j) (i=2n; n=1~64 and 449~512) with the black data written, their pixel voltages Vpix(2), Vpix(4), Vpix(6), . . . , Vpix(128) and Vpix(898), Vpix(900), Vpix (902), . . . , Vpix(1024) [i.e. Vpix(2n) (n=1~64 and 449~512)] each have a voltage shift ΔV1 caused therein in accordance with the expression (1), when the even-numbered scan lines GP-i (i=2n; n=1~64 and 449~512) each go out from the selected state to a non-selected state.

At that time, odd-numbered scan lines GP-i (i=2n−1; n=1~512) each have a common voltage, which voltage corresponds to a storage capacitor electrode voltage of the pixels Px(i, j) (i=2n; n=1~512) so that the voltage shift ΔV1 is free from the adverse effect of a capacitive coupling.

In this respect, at respective pixels Px(i, j) (i=2n−1; n=1~64 and 449~512) of which TFTs are connected to the odd-numbered scan lines GP-i (i=2n−1; n=1~512), their pixel voltages Vpix(1), Vpix(3), Vpix(5), . . . , Vpix(127) and Vpix(897), Vpix(899), Vpix(901), . . . , Vpix(1023) [i.e. Vpix(2n−1) (n=1~64 and 449~512)] each have a voltage shift ΔV3 caused therein in accordance with the expression (3), when the even-numbered scan lines GP-i (i=2n; n=1~64 and 449~512) and the bus line GP-0 each enter from a non-selected state to a selected state, as well as when going out from the selected state to a non-selected state.

In other words, in the (4m+3)-th blanking period, the pixel voltage Vpix(i) (i=2n−1; n=1~64 and 449~512) at each pixel in odd-numbered rows is shifted in a (rise) direction by a voltage ΔV3 at a start time of the black write period-2 in which pixels in even-numbered rows have a black data written therein, and in an opposite (fall) direction by the same voltage ΔV3 at an end time of this period-2, so that it has an identical level before and after the concerned period-2.

In an image writing period following the (4m+3)-th blanking period, even-numbered ones GP-i (i=2n; n=65~448) of the scan lines GP-i (i=129~896) in the picture region are sequantially selected so that corresponding pixels Px(i, j) (i=2n; n=65~448) have image data stored therein with a positive polarity.

As a result, at respective lines to be displayed in black, each pixel voltage for the black display has an idential voltage shift ΔV1 caused therein when a corresponding scan line goes out from a selected state to a non-selected state, whether it is odd-numbered or even-numbered.

In the image writing period also, each pixel voltage for the image display has a voltage shift ΔV1 caused therein when a corresponding scan line goes out from a selected state to a non-selected state, which voltage shift is identical to the voltage shift ΔV1 for the black display. Accordingly, an identical voltage shift is caused all over the display region, permitting a competent image quality to be achieved.

Therefore, the LCD of a gate storage struture is adapted for a desirable vertical black write action to be performed in an interlacing manner.

From the foregoing embodiments described, the TFT 601 of FIG. 3 may be a polycrystalline silicon TFT, amorphous silicon TFT or CdS TFT formed on a glass substrate, or a monocrystalline silicon MOS transistor.

According to an embodiment of the invention, in an LCD of a gate storage structure, an odd-numbered scan line and an even-numbered scan line are permitted to alternatively have a common potential so that in those pixels connected to a selected scan line their pixel voltages can undergo a relatively small voltage shift free from the adverse effect of a capacitive coupling.

Moreover, in an interlacing scan mode in an LCD of a gate storage structure, an odd-numbered scan line and an even-numbered scan line are again permitted to alternatively have a common potential so that in those pixels connected to a selected scan line their pixel voltages can undergo a relatively small voltage shift free from the adverse effect of a capacitive coulping.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A driving method for a liquid crystal display including a plurality of scan lines, a plurality of signal lines crossing the scan lines, and a matrix of pixels having switching elements and storage capacitors connected between the scan and signal lines, the driving method comprising the steps of:

dividing a blanking period into a first portion and a second portion;

selecting one of two neighboring scan lines;

driving said selected scan line for a first black write action for an arbitrary one of the plurality of signal lines in the first portion of the blanking period;

selecting a remaining one of the two neighboring scan lines; and driving said remaining scan line for a second black write action for the arbitrary signal line in the second portion of the blanking period.

2. A driving method according to claim 1, wherein said first black write action is different in phase from said second black write action.

3. A driving method according to claim 1, wherein said black write action writes a black data with a polarity different from a polarity of a black data to be written by said second black write action.

4. A driving method for a liquid crystal display including a plurality of scan lines, a plurality of signal lines crossing the scan lines, and a matrix of pixels having switching elements and storage capacitors connected between the scan and signal lines, the driving method comprising the steps of:

dividing a blanking period into a first black writing period and a second black writing period;

selecting one of two neighboring scan lines;

driving said selected one during said first black writing period for a first black write action for an arbitrary one of the signal lines in a first of a pair of neighboring blanking periods;

selecting a remaining one of the two neighboring scan lines; and driving said remaining one during said second black writing period for a second black write action of the arbitrary signal line in a second of said pair of neighboring blanking periods.

5. A driving method according to claim 4, wherein said first black write action writes a black data with a polarity different from a polarity of a black data to be written by said second black write action.

6. A driving method for a liquid crystal display apparatus wherein switching elements are positioned adjacent an intersection point of a (n+1)th scan line and a signal line, where n is a positive integer, and wherein storage capacitors are formed between pixel electrodes connected to the switching element and an n-th scan line, the driving method comprising the steps of:

in a first scan process, writing blacking data simultaneously while selecting more than two odd numbered scan lines from among the scan lines by using a same scan signal in a first portion of a blanking period; and in a second scan process, writing blacking data simultaneously while selecting more than two even numbered scan lines from among the scan lines by using the same scan signal in a second portion of said blanking period.

7. A driving method for a liquid crystal display apparatus as claimed in claim 6, wherein in a K-th blanking period, K being a positive integer, a positive polar blacking data signal is input during both said first and second portions of said blanking periods, and wherein at the (K+1)th blanking period, a negative polar data signal is input at both said first and second portions of said blanking periods.

8. A driving method for a liquid crystal display apparatus as claimed in claim 6, wherein at the K-th blanking period, K being a positive integer, the blacking data which is written at the first scan process has a different polarity to the data which is written at the second scan process.

9. A driving method for a liquid crystal display apparatus in which switching elements are positioned adjacent an intersection point of an (n+1)th scan line and a signal line which crosses said (n+1)th scan line, n being a positive integer, and in which storage capacitors are formed between pixel electrodes connected to the switching element at an n-th scan line, the driving method comprising the steps of:

dividing a blanking period into a first black writing period and a second black writing period;

in a first scan process during said first black writing period, writing blacking data simultaneously while selecting more than two odd numbered scan lines from among the scan lines by using a same scan signal in one of a (2m+1)-th or (2m)-th blanking period, where m is a positive integer; and in a second scan process during said second black writing period, writing blacking data simultaneously while selecting more than two even numbered scan lines from among the scan lines by using the same scan signal in one of a (2m)th or (2m−1)-th blanking period.

10. A driving method for a liquid crystal display apparatus as claimed in claim 9, wherein the blacking data which is written during the first scan process comprises a different polarity than the data written during the second scan process.

11. A method for driving a pixel display device to display a black area around a picture when the picture is formatted for a smaller number of pixels than said display device, said display device comprising a plurality of scan lines and signal lines, said method comprising the steps of:

dividing a blanking period into a first black write period and a second black write period;

driving odd numbered scan lines in said black area when a blacking data signal is on corresponding signal lines during said first black write period; and driving even numbered scan lines in said black area when a blacking data signal is on corresponding signal lines during said second black writing period, wherein said first black writing period ends prior to the start of said second black writing period such that there is a period between said first and said second black writing periods when both said odd numbered scan lines and even numbered scan lines are driven by a common potential to reduce capacitive coupling between adjacent pixels.

12. A method for driving a pixel display device as recited in claim 11 wherein said blacking data in said first and said second blacking periods have a same polarity.

13. A method for driving a pixel display device as recited in claim 11 wherein said blacking data in said first and said second blacking periods have an opposite polarity.

* * * * *